US008876364B2

(12) United States Patent
Gartmann et al.

(10) Patent No.: US 8,876,364 B2
(45) Date of Patent: Nov. 4, 2014

(54) DYNAMIC MIXER WITH A SEAL

(75) Inventors: Valentin Gartmann, Bad Ragaz (CH); Percy Leue, Singen (DE)

(73) Assignee: Sulzer Mixpac AG, Haag (CH)

( * ) Notice: Subject to any disclaimer, the term of this patent is extended or adjusted under 35 U.S.C. 154(b) by 76 days.

(21) Appl. No.: 13/554,740

(22) Filed: Jul. 20, 2012

(65) Prior Publication Data

US 2013/0021869 A1 Jan. 24, 2013

(30) Foreign Application Priority Data

Jul. 22, 2011 (EP) ..... 11175047

(51) Int. Cl.

| | |
|---|---|
| ***B01F 7/20*** | (2006.01) |
| ***B01F 7/00*** | (2006.01) |
| ***B01F 7/18*** | (2006.01) |
| ***B01F 13/00*** | (2006.01) |
| ***B05B 7/04*** | (2006.01) |

(52) U.S. Cl.

CPC ..... *B01F 7/00125* (2013.01); *B01F 7/00141* (2013.01); *B01F 7/00641* (2013.01); *B01F 7/18* (2013.01); *B01F 13/0023* (2013.01); *B05B 7/04* (2013.01); *B01F 2215/0027* (2013.01)

USPC ..... 366/172.1; 366/331

(58) Field of Classification Search

USPC ..... 366/172.1, 249, 331

See application file for complete search history.

(56) References Cited

U.S. PATENT DOCUMENTS

| | | | | |
|---|---|---|---|---|
| 6,244,740 | B1 * | 6/2001 | Wagner et al. | 366/181.5 |
| 6,443,612 | B1 * | 9/2002 | Keller | 366/307 |
| 2002/0175186 | A1 | 11/2002 | Keller | |
| 2003/0137898 | A1 * | 7/2003 | Wagner et al. | 366/172.1 |
| 2008/0056061 | A1 * | 3/2008 | Pauser et al. | 366/152.2 |
| 2009/0296516 | A1 * | 12/2009 | Keller | 366/160.5 |
| 2010/0208544 | A1 * | 8/2010 | Wintergerste et al. | 366/134 |

FOREIGN PATENT DOCUMENTS

| | | | |
|---|---|---|---|
| DE | 3307558 | A1 | 9/1984 |
| DE | 4235736 | C1 | 3/1994 |
| EP | 1836992 | * | 9/2007 |
| WO | 98-43727 | A1 | 10/1998 |
| WO | 2007-041878 | A1 | 4/2007 |

OTHER PUBLICATIONS

European search report for corresponding EP11175047.7-2307 issued on Jan. 9, 2012.

* cited by examiner

*Primary Examiner* — Charles Cooley
*Assistant Examiner* — Marc C Howell
(74) *Attorney, Agent, or Firm* — K&L Gates LLP

(57) ABSTRACT

A dynamic mixer for a plurality of fluid components contains a housing and a rotor element which is rotatably arranged in the housing, with the housing having one inlet opening for at least one component each and at least one outlet opening. A ring-shaped intermediate space is provided between the rotor element and the housing in which a mixing element connected to the rotor element is arranged. A seal for sealing the rotor element in the mixer housing is provided at the bearing location of the rotor element in the housing.

14 Claims, 4 Drawing Sheets

DYNAMIC MIXER WITH A SEAL

PRIORITY CLAIM

The present application claims priority to European Patent Application No. 11175047.7 filed on Jul. 22, 2011, the disclosure of which is incorporated herein by reference.

BACKGROUND

The invention relates to a seal for a dynamic mixer. Such a dynamic mixer is in particular used in the mixing of a plurality of viscous or pasty components such as impression materials in the dental sector, two-component adhesives or sealing materials.

A dynamic mixer is known from WO 2007/041878 for mixing components having different volume proportions, in particular for manufacturing dental impression materials. An antechamber is arranged in the inner space of the mixer housing within which the mixing rotor has a distribution body for distributing the components about its axis of rotation in order thereby to achieve a correct mixing ratio between the components and to avoid air inclusions. Subsequently, the premixed components move into a main chamber through at least one passage opening for their complete mixing.

Since the components react with one another and harden in the mixer on an interruption of the dispensing, the mixer must be replaced and disposed of after use together with the components contained therein. The components can in particular move into the intermediate space between the mixing rotor and the cover of the mixer housing, and indeed exactly at that point at which the mixing rotor is supported in the cover. For this reason, a sealing lip which is arranged downstream of the bearing location is provided in WO2007/041878.

However, it has proved to be disadvantageous in the embodiment in accordance with WO2007/041878 that the components entering into the intermediate space between the cover and the mixing rotor through the inlet openings can move into the intermediate space between the sealing lip and the inner wall of the cover, can remain there and can react uncontrollably with one another. Reactions of this type can vary the consistency of the components and impair the mixing performance as well as cause inhomogeneity in the mixture. When such components harden on longer contact, clumps may be formed which are undesired in the mixture, which impair the quality of the mixture or which even allow the mixture to become unusable. Such a clumping can also impair the operation of the mixer with a sufficient size in that the intermediate spaces between the mixing rotor and the housing are clogged. The mixer can thus even become unusable.

SUMMARY

It is therefore the object of the invention to ensure that the dwell time of the components in the mixture is as constant as possible and fluctuations in the dwell time due to dead zones can be avoided. Dead zones are to be understood in this respect as zones in which the mix, that is the components, remain in the mixer without being conveyed in the unmixed or partly mixed state.

The object of the invention is satisfied by a dynamic mixer for a plurality of fluid components which has a housing and a rotor element which is rotatably arranged in the housing. The housing has an inlet opening for at least one component each and at least one outlet opening. A ring-shaped intermediate space is provided between the rotor element and the housing in which a mixing element connected to the rotor element is arranged. A seal for sealing the rotor element in the mixer housing is provided at the bearing location of the rotor element in the housing.

The seal can in particular include a first sealing element and a second sealing element so that it can be precluded that filler material is discharged from the housing. One of the first or second sealing elements is advantageously designed as a sealing lip. At least one of the first or second sealing elements can have a sealing surface on the rotor element which is supported in a sealing surface of the housing. In accordance with an embodiment, the sealing surface can have a profiled structure. The profiled structure can selectively be provided at the rotor element or in the opening of the housing which is intended for receiving the rotor element.

In accordance with an embodiment, the first sealing element is arranged upstream of the second sealing element. The first sealing element can in particular be designed as a sealing lip. The second sealing element can in particular be designed as a sealing surface.

In accordance with an embodiment, the sealing lip has a flank at the inlet side, an apex and a flank at the outlet side. The angle which the flank at the inlet side includes with the sealing surface is in particular smaller than the angle which the flank at the outlet side includes with the sealing surface. The inner diameter of the sealing surface is advantageously larger than the minimum inner diameter of the sealing lip when the rotor element is not installed in the housing.

In accordance with an embodiment, the housing includes a first housing part and a second housing part, with the first housing part containing the inlet openings and the second housing part containing the outlet opening. The rotor element is in particular supported in the first housing part. In accordance with this embodiment, the housing includes a first antechamber and a main chamber, with the inlet openings opening into the first antechamber. In accordance with an alternative embodiment, a second antechamber can be provided between the first antechamber and the main chamber for a better premixing. At least one opening between the rotor element and the housing for the passage of the components can be arranged between the first antechamber and the second antechamber. Furthermore, a mixer element can be arranged in at least one of the first and second antechambers to further intensify the premixing.

It has been found that, contrary to the experience from the prior art, good results are also achieved with respect to the homogenization of the dwell time when a sealing lip is provided to prevent secondary flows arising along the inner wall of the first housing part facing the rotor element. Homogenization of the dwell time is to be understood as a reduction of the deviations of the actual dwell time from the dwell time desired by the chemical reaction. If the sealing lip is provided upstream of the bearing location of the rotor in the first housing part, the bearing location acquires an additional function as a labyrinth. Any backflow of the components out of the antechamber can thus be prevented by the labyrinth. If, against all expectations, a backflow of the components through the labyrinth should occur, a sealing lip is provided which prevents these components from again entering into the inflow passages so that such a side flow can be prevented during the whole operating time of the mixer.

The mixing ratio of the first and second components can amount to 1:1, but can also amount to up to 1:5, at a maximum up to 1:50.

The use of the dynamic mixer preferably takes place in autonomous manual dispensing units or in stationary desktop units.

Additional features and advantages are described herein, and will be apparent from the following Detailed Description and the figures.

DETAILED DESCRIPTION

Figure 1:
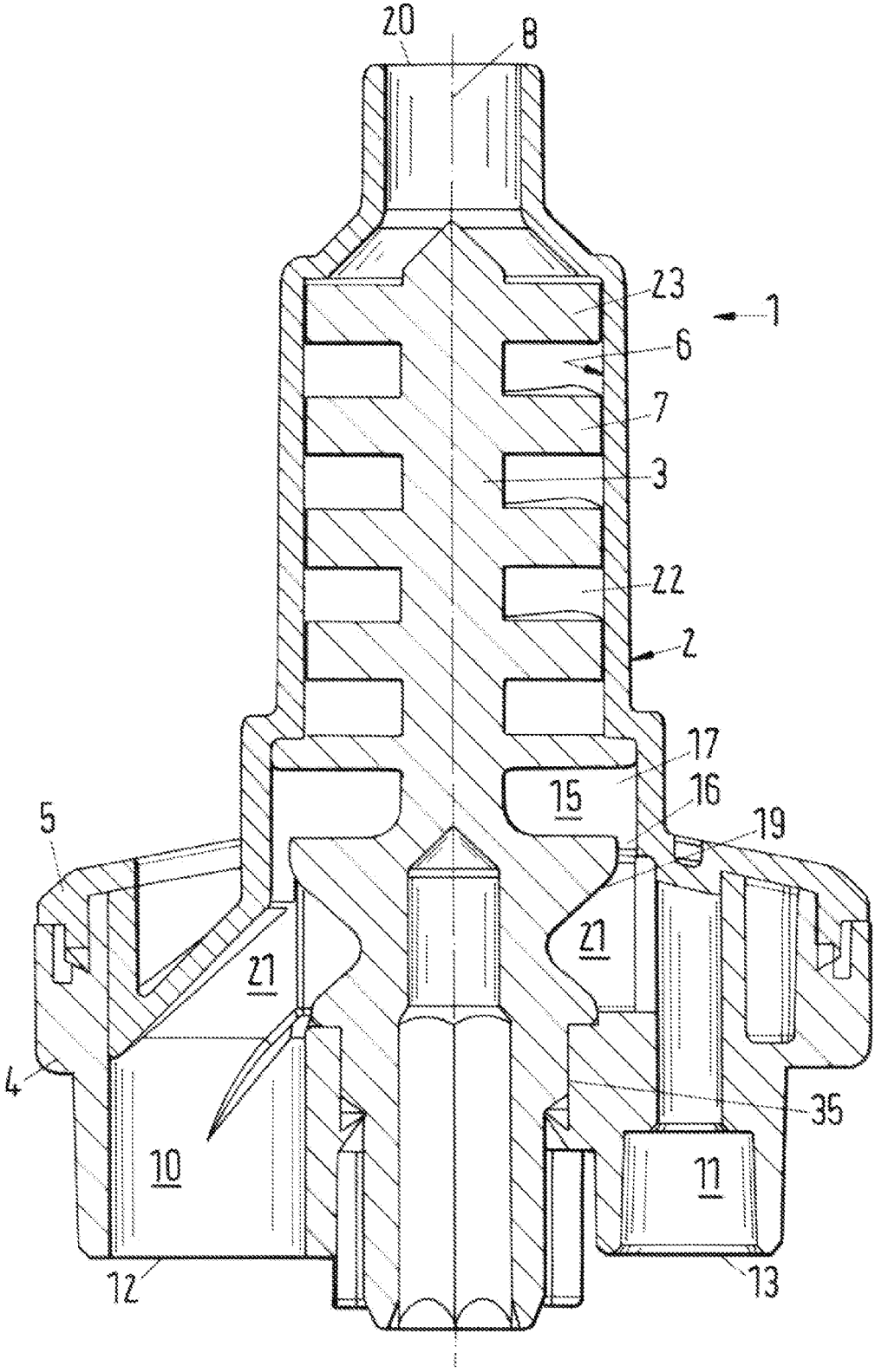
FIG. 1 is a section through a dynamic mixer in accordance with a first embodiment of the invention.

FIG. 1 shows a dynamic mixer for a plurality of fluid components. The dynamic mixer 1 has a housing 2 and a rotor element 3 which is arranged rotatably about a rotor axis 8 in the housing 2. In the present embodiment, the housing 2 is made in two parts; it contains a first housing part 4 in which the inflow of the components is located and a second housing part 5 which serves for the production of a mixture from the plurality of fluid components. The first housing part is connected to the second housing part via a latch connection, a snap-in connection or a weld connection as soon as the rotor element 3 is received in the second housing 5. The first housing part 4 has an inlet opening 12, 13 for at least one component each. The inlet openings 12, 13 can have different diameters which are dependent on the desired mixing ratio of the components. The inlet openings open into corresponding inlet passages 10, 11 which are arranged in the first housing part 4. The inlet passages 10,11 open into an antechamber 21 which is provided with outlet openings 16 which are designed substantially as an outer ring gap and which open into an inner space 15 of the second housing part 5.

The second housing part 5 has at least one outlet opening 20. The mixture of the components exits the dynamic mixer through the outlet opening 20. The inner space 15 of the second housing part 5 serves for the reception of the rotor element 3.

The inner space 15 has a second antechamber 17 and a main chamber 22. The components which have been brought into contact with one another for the first time and premixed in the first antechamber 21 come into the second antechamber 17. The components are conducted from the second antechamber 17 to the main chamber 22. A further mixing can take place in the second antechamber 17. For this purpose, at least one rotary surface 19, which is designed as a rotationally symmetrical section of the rotor element 3, is in the second antechamber. The rotary surface has a variable diameter, in particular a reducing and/or increasing diameter. Shear forces are exerted onto the components by the rotary surface 19. The components are hereby admixed with one another in a relatively finely spaced manner.

A ring-shaped intermediate space which forms the main chamber 22 in which a mixing element 7 connected to the rotor element 3 is arranged is provided between the rotor element 3 and the inner wall 6 of the housing.

The mixing element 7 includes a plurality of wing elements 23 in the main chamber 22. The wing elements 23 protrude as projections into the main chamber 22. The final mixing of the components takes place in this main chamber 22 in that the components are taken up by the wing elements and are rearranged. At least some of the wing elements can be formed as guide elements for conveying the components through the inner space 15 in the direction of the outlet opening 20.

The rotor element is supported in the housing at a bearing location 35. In accordance with FIG. 1, the rotor element is supported in the first housing part 4 which forms the cover for the second housing part 5.

Figure 2:
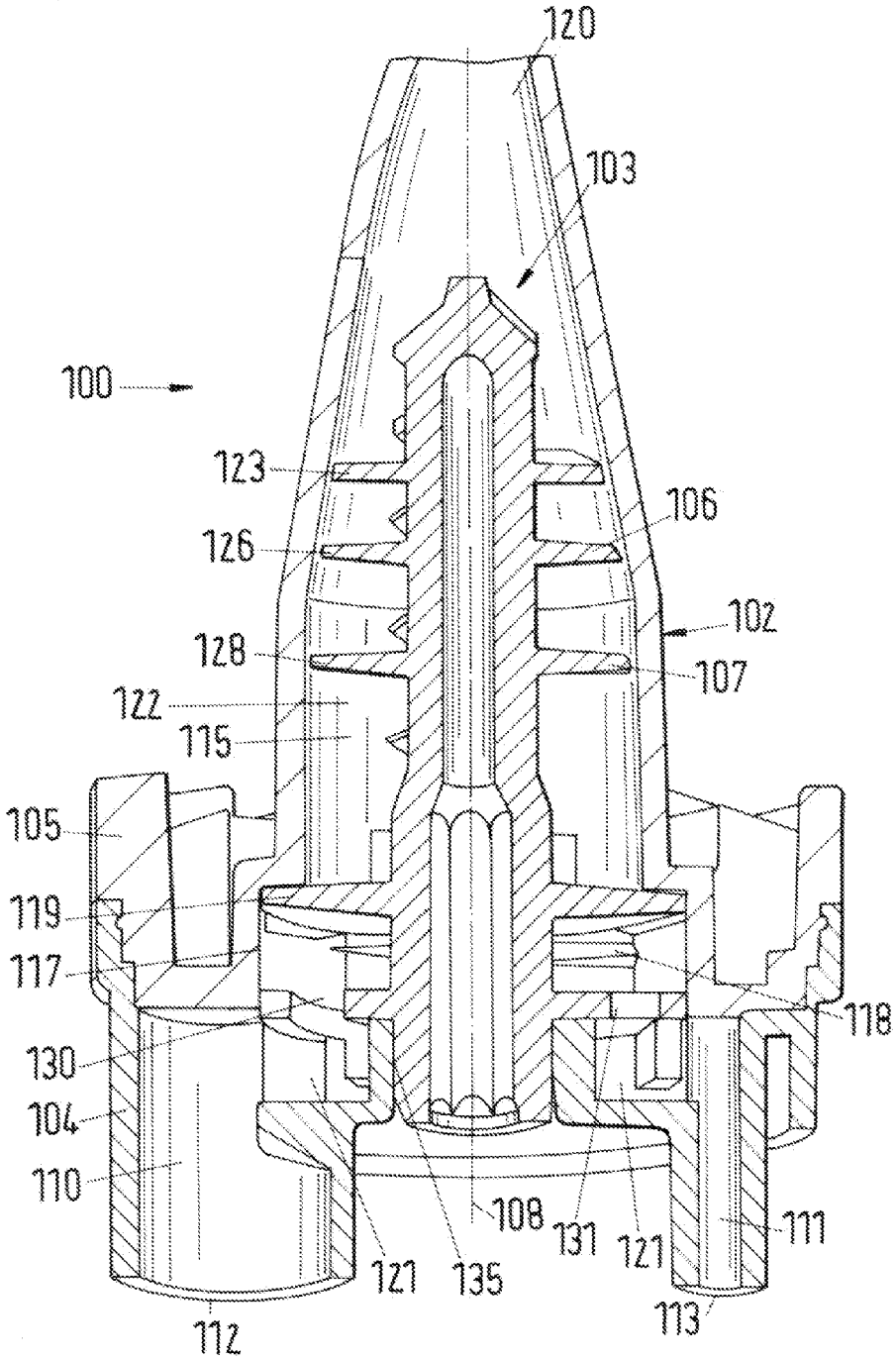
FIG. 2 is a section through a dynamic mixer in accordance with a second embodiment of the invention.

FIG. 2 shows a section through a dynamic mixer 100 in accordance with a second embodiment of the invention for the mixing of a plurality of fluid components. The dynamic mixer 100 has a housing 102 and a rotor element 103 which is arranged rotatably about a rotor axis 108 in the housing 102. In the present embodiment, the housing 102 is made in two parts; it contains a first housing part 104 in which the inflows of the components are located and a second housing part 105 which serves for the production of a mixture from the plurality of fluid components. The first housing part is connected to the second housing part via a latch connection, a snap-in connection or a weld connection as soon as the rotor element 103 is received in the second housing 105. The first housing part 104 has one inlet opening 112, 113 for at least one component each. The inlet openings 112, 113 can have different diameters which are dependent on the desired mixing ratio of the components. The inlet openings open into corresponding inlet passages 110, 111 which are arranged in the first housing part 104. The inlet passages 110, 111 open into a first antechamber 121 which is provided with outlet openings 130 which open into an inner space 115 of the second housing part 105.

The second housing part 105 has at least one outlet opening 120. The mixture of the components exits the dynamic mixer through the outlet opening 120. The inner space 115 of the second housing part 105 serves for the reception of the rotor element 103.

The inner space 115 includes a second antechamber 117 and a main chamber 122. The components which have been brought into contact with one another for the first time and premixed in the first antechamber 121 come into the second antechamber 117. The components are conducted from the second antechamber 117 to the main chamber 122. A further premixing can take place in the second antechamber 117. A mixing element 118 is arranged in the second antechamber 117 for this purpose. The mixing element 118 is formed as a wing element which is connected to the rotor element 103. In addition, further wing elements 118 can be arranged on a rotary surface 119 of the rotor element 103, which is not shown in FIG. 2. Shear forces are exerted onto the components by the rotary surface 119 and the mixing elements 118. The components are hereby further admixed with one another.

A ring-shaped intermediate space in which a mixing element 107 connected to the rotor element 103 is arranged is provided between the rotor element 103 and the inner wall of the housing.

The mixing element 107 includes a plurality of wing elements 123 in the main chamber 122. The wing elements 123 protrude as projections into the inner space 115 which forms the main chamber 122. The mixing of the components takes place in this main chamber in that the components are taken up by the wing elements and are rearranged. At least some of the wing elements are formed as a guide element for conveying the components through the inner space 115 in the direction of the outlet opening 120. It is not necessary that adjacent wing elements arranged behind one another with respect to the rotor axis 108 have the same spacing from one another. The spacing of the wing element 123 arranged closest to the outlet opening 120 from the wing element 126 is, for example, smaller than the spacing of the wing element 126 from the wing element 128.

The rotor element is supported in the housing at a bearing location 135. In accordance with FIG. 1, the rotor element is supported in the first housing part 4 which forms the cover for the second housing part 5.

Figure 3:
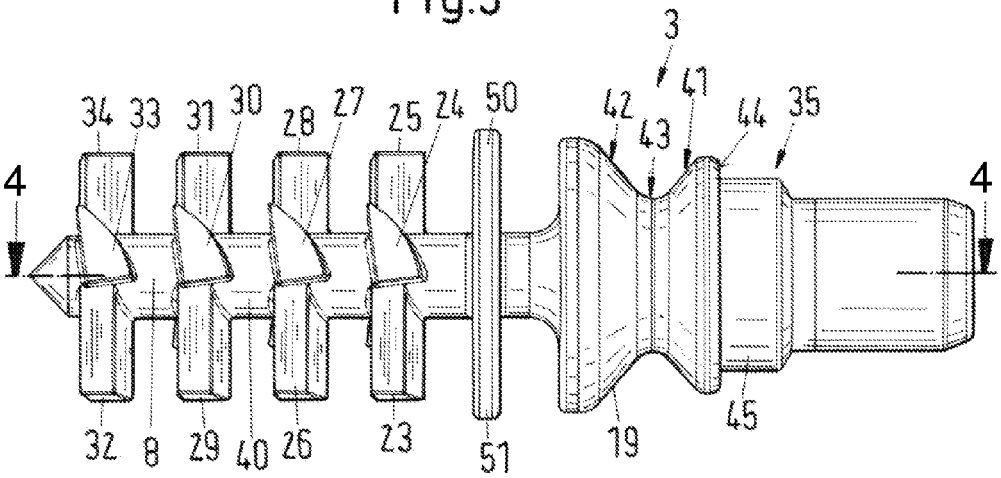
FIG. 3 is a view of a rotor element for a dynamic mixer.
Figure 4:
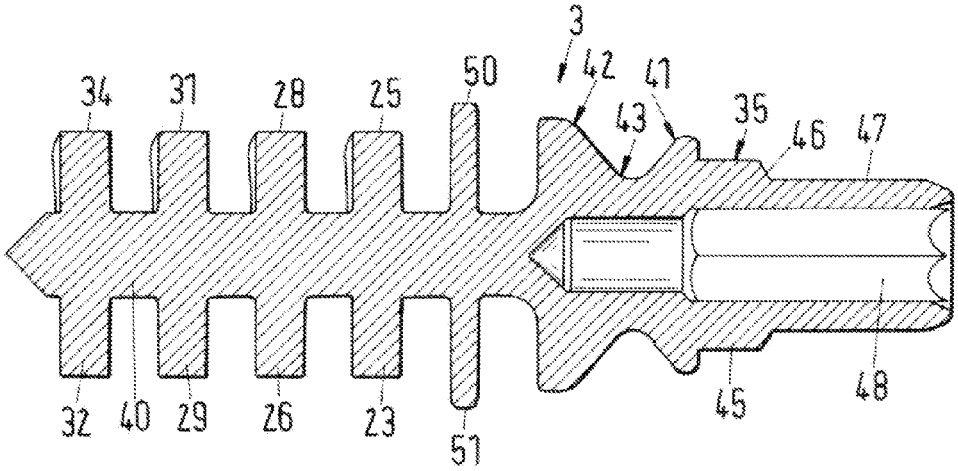
FIG. 4 is a section through the rotor element in accordance with FIG. 3.

FIG. 3 shows a view of a rotor element for use in one of the dynamic mixers. FIG. 4 shows a section through the rotor element in accordance with FIG. 3. The rotor element corresponds to the rotor element 3 shown in FIG. 1; so the same reference numerals as in FIG. 1 are therefore used for the same parts. However, this reference is not to be understood as a restriction such that the rotor element can only be used in connection with the embodiment in accordance with FIG. 1. It is rather the case that the rotor element can likewise be used in a housing in accordance with any one of the other embodiments with a slight adaptation of the geometry of the housing. The rotor element 3 has a rotor axis 8 along which a rotor element hub 40 is arranged. The rotor element hub 40 bears a rotary surface 19 which forms the inner boundary of the antechamber 21. The rotary surface 19 is composed of a first conical surface part 41 and a second conical surface part 42. An indentation 43 is located between the first conical surface part 41 and the second conical surface part 42. The extent of the cross-sectional surface of the rotary surface is selected in this manner to exert shear forces which are as high as possible onto the filler material which surrounds the rotary surface 19 in the operating state. The filler material, that is the components supplied through the inlet openings, comes into contact with the rotor element for the first time at the rotary surface 19.

A shoulder 44 is located upstream of the first conical surface part 41. The shoulder 44 is the boundary of the bearing location 35 at the filler material side. The bearing location 35 is formed by a cylindrical support surface 45. A further shoulder 47 which is adjoined by the drive end 47 of the rotor element is located upstream of the cylindrical support surface. The drive end of the rotor element can be equipped with a coupling element 48 to connect the rotor element to a rotary drive, not shown. In the present representation in accordance with FIG. 4, the coupling element is designed as a central bore which has the shape of a hexagon socket.

The diameter of the rotor element is in turn reduced downstream of the rotary surface 19 to provide the filler material with an inner space in the second housing part (see FIG. 1). The filler material is collected in this inner space and is conveyed in the direction of the mixer outlet by the rotary movement of the part of the rotary surface 19 at the outlet side. The rotor element contains a disk element 50 so that there is a further mixture of the components of the filler material. The filler material is conducted along the disk element 50 at its side at the entry side in the direction of the inner wall of the second housing part. A ring-shaped gap is formed between the disk margin 51 and the inner wall of the second housing part and the filler material is pressed through it in the direction of the main chamber 22.

Ring-shaped gap segments can also be provided instead of the ring-shaped gap when the disk element is equipped with projections or tines which extend up to the inner wall of the second housing part. This embodiment is not shown in the Figures.

Furthermore, wing elements 23, 24, 25, 26, 27, 28 which are designed as guide elements are arranged downstream of the disk element in the main chamber. In addition, wing elements can be provided which are formed in diamond shape as described, for example, in WO98/43727. Furthermore, an arcuate wing element can be provided which is directly adjacent to the disk element 50 and which shears the filler material from the entry openings and conducts it into the main chamber, which is likewise not shown in graphic form. Such an arcuate wing element can be found, for example, in the European application EP11156133.8 of the same applicant. Similar wing elements can also be arranged further downstream and effect a scraping off of the filler material from the wall of the main chamber 22.

Wing elements of the same kind are preferably arranged disposed opposite one another at the same level such as, for example, the wing element pair 23, 25 or the wing element paper 26, 28, with the height being measured along the rotor axis 8. The same height now means the same spacing from the end face of the inlet end of the rotor element or corresponding to the end face from its outlet end. A further wing element which is not visible in FIG. 3 or FIG. 4 can be provided for each of the wing elements 24, 27.

The wing elements can be arranged behind one another; the wing elements 26, 27, 28 are thus arranged downstream of the wing elements 23, 24, 25. Two further rows of wing elements are shown in FIG. 3 and FIG. 4, the wing elements 29, 30, 31 and 32, 33, 34. The number of rows of the wing elements is dependent on the mixing task.

Figure 5:
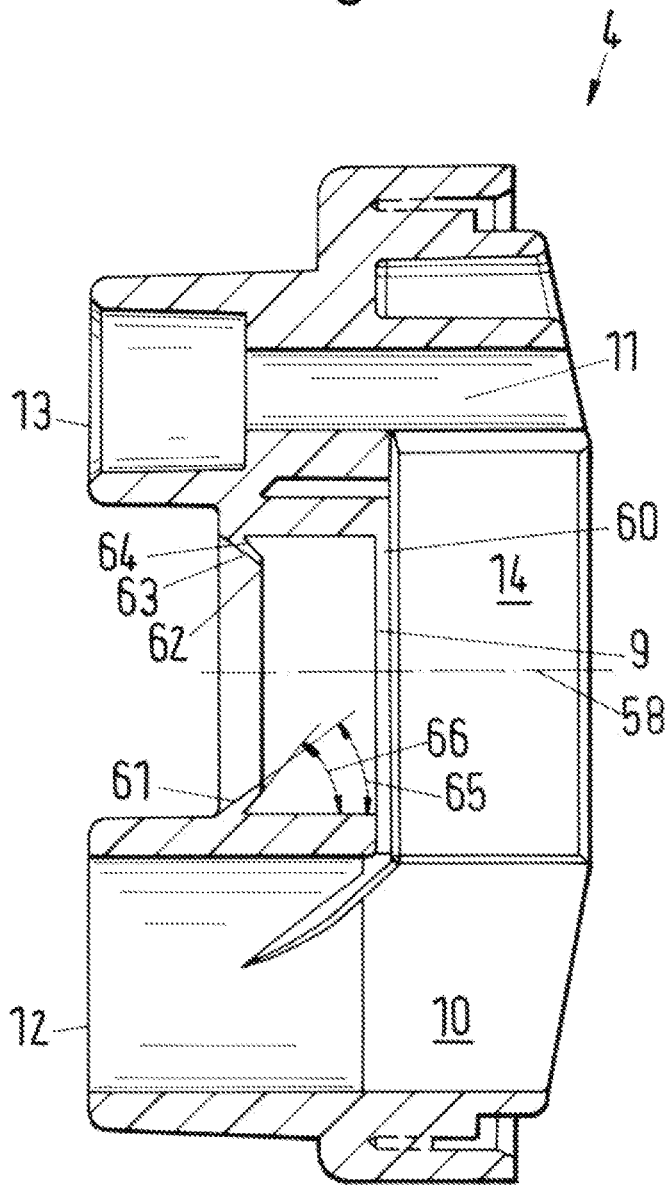
FIG. 5 is a section through the first housing part of a dynamic mixer in accordance with FIG. 1.

FIG. 5 shows a section through the first housing part 4 of the mixer shown in FIG. 1. The first housing part 4 contains the first inlet passage 10 and the second inlet passage 11 which end in the corresponding first inlet opening 12 and the second inlet opening 13. The first inlet passage 10 and the second inlet passage 11 open into a first inner space 14. The first inner space 14 is provided with an opening 9 which is intended for receiving a rotor element in accordance with one of the preceding embodiments. The axis 58 corresponds to the rotor axis 8 of the rotor element in the installed state. The opening contains the bearing location 35 for the rotor element. The bearing location 35 is designed as a cylindrical section 60 which serves for receiving the corresponding cylindrical support surface 45 of the rotor element 8. A sealing element formed as a sealing lip 61 adjoins the cylindrical section 60 in the direction of the inlet opening. Alternatively, a plurality of sealing lips can be arranged in the opening, which is not shown graphically The sealing lip 61 is designed as a peripheral projection which has an apex 62 as well as a flank 63 at the inlet side and a flank 64 at the outlet side. The flank 63 at the inlet side and the flank 64 at the outlet side include an angle 65, 66 in the section plane with the line of intersection of the inner wall of the sealing surface 60 which is designed as a cylindrical section 60 here. The sealing surface could, however, also be a conical section. Furthermore, the sealing surface can contain a profiled section which can in particular be designed as grooves extending in the peripheral direction.

The angle 65, 66 should in each case be measured at the outlet side. The angle 65 which the flank 63 at the inlet side includes with the line of intersection of the inner wall of the sealing surface differs from the angle 66 which the flank 64 at the outlet side includes with the line of intersection of the inner wall. The angle 65 at the inlet side is in particular smaller than the angle 66 at the outlet side. The angle 66 at the outlet side preferably amounts to more than 45° and can reach up to and into a range of 80°. An elastic deformation of the projection can occur in this range when the rotor element is pushed into the opening.

Since the sealing lip is arranged upstream of the cylindrical section 60, a filler material can move from the antechamber 21 into the first inner space 14 closed by the projection element bearing the rotary surface 19. The filler material is conveyed by the rotor element in the direction of the mixer outlet, that is a bypass current through the bearing point 35 can thus be avoided. If filler material were actually to move into the bearing location, the sealing element would prevent a further advancing of the filler material. Any contamination of the components which reach the mixer via the inlet openings 12, 13 can thus be precluded.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A dynamic mixer for a plurality of fluid components, containing a housing and a rotor element which is rotatably arranged in the housing, wherein the housing comprises two inlet openings, each inlet opening corresponding to at least one component, and at least one outlet opening, wherein a ring-shaped intermediate space is provided between the rotor element and the housing and a mixing element connected to the rotor element is arranged therein, characterized in that a seal for sealing the rotor element is provided in the mixer housing at a bearing location of the rotor element in the housing, wherein the seal includes a first sealing element and a second sealing element, wherein the second sealing element comprises a cylindrical support surface on the rotor element which is supported in a cylindrical section of the housing, and wherein the first sealing element is arranged upstream of the second sealing element so that the second sealing element is positioned between the first sealing element and the at least one outlet opening.

2. A dynamic mixer in accordance with claim 1, wherein the first sealing element is designed as a sealing lip.

3. A dynamic mixer in accordance with claim 1, wherein the cylindrical support surface on the rotor element or the cylindrical section of the housing has a profiled structure.

4. A dynamic mixer in accordance with claim 2, wherein the sealing lip is shaped as a peripheral protrusion.

5. A dynamic mixer in accordance with claim 4, wherein the sealing lip has a flank at the inlet side, an apex and a flank at the outlet side.

6. A dynamic mixer in accordance with claim 5, wherein an angle which the flank at the inlet side includes with the cylindrical section of the housing is smaller than an angle which the flank at the outlet side includes with the cylindrical section of the housing.

7. A dynamic mixer in accordance with claim 1, wherein an inner diameter of the cylindrical section of the housing is larger than a minimal inner diameter of the sealing lip when the rotor element is not installed in the housing.

8. A dynamic mixer in accordance with claim 1, wherein the housing has a first housing part and a second housing part, wherein the first housing part contains the two inlet openings and the second housing part contains the outlet opening.

9. A dynamic mixer in accordance with claim 8, wherein the rotor element is supported in the first housing part.

10. A dynamic mixer in accordance with claim 1, wherein the housing includes a first antechamber and a main chamber, and wherein the two inlet openings open into the first antechamber.

11. A dynamic mixer in accordance with claim 10, wherein a second antechamber is provided between the first antechamber and the main chamber.

12. A dynamic mixer in accordance with claim 11, wherein at least one opening is provided between the rotor element and the housing for the passage of the components between the first antechamber and the second antechamber.

13. A dynamic mixer in accordance with claim 10, wherein a mixing element is arranged in at least one of the first and second antechambers.

14. A dynamic mixer in accordance with claim 1, wherein the two inlet openings are connected to an inner space that contains the bearing location of the rotor element.

* * * * *